US011295877B2

(12) United States Patent
Pizzato et al.

(10) Patent No.: US 11,295,877 B2
(45) Date of Patent: Apr. 5, 2022

(54) POTENTIOMETER FOR CONTROLLING ELECTRICAL CIRCUITS

(71) Applicants: PIZZATO ELETTRICA S.R.L., Marostica (IT); Simone Zonta, Bassano del Grappa (IT)

(72) Inventors: Marco Pizzato, Marostica (IT); Simone Zonta, Bassano del Grappa (IT)

(73) Assignee: PIZZATO ELETTRICA S.R.L., Marostica (IT)

( * ) Notice: Subject to any disclaimer, the term of this patent is extended or adjusted under 35 U.S.C. 154(b) by 0 days.

(21) Appl. No.: 17/048,621

(22) PCT Filed: Apr. 19, 2019

(86) PCT No.: PCT/IB2019/053259
§ 371 (c)(1),
(2) Date: Oct. 19, 2020

(87) PCT Pub. No.: WO2019/202562
PCT Pub. Date: Oct. 24, 2019

(65) Prior Publication Data

US 2021/0125756 A1 Apr. 29, 2021

(30) Foreign Application Priority Data

Apr. 20, 2018 (IT) ..... 102018000004741

(51) Int. Cl.
*H01C 1/022* (2006.01)
*H01C 10/14* (2006.01)

(52) U.S. Cl.
CPC ..... *H01C 1/022* (2013.01); *H01C 10/14* (2013.01)

(58) Field of Classification Search
CPC ..... H01C 1/022; H01C 1/024; H01C 10/005; H01C 10/14; H01C 10/32
See application file for complete search history.

(56) References Cited

U.S. PATENT DOCUMENTS

RE19,605 E * 6/1935 Flanzer ..... H01C 10/32 338/171
3,498,147 A * 3/1970 Cameron ..... H01H 25/06 74/10.45
3,512,427 A * 5/1970 Metcalf ..... H01H 13/58 74/471 R
3,611,245 A * 10/1971 Puerner ..... H01C 10/36 338/134

(Continued)

*Primary Examiner* — Kyung S Lee
(74) *Attorney, Agent, or Firm* — Mark M. Friedman

(57) ABSTRACT

A potentiometer comprises a cylindrical case (2) having an upper edge portion (3) and housing an electric adjustment device (5) enclosing a variable resistance, means (8) for the electrical connection of the electrical adjustment device (5) to the circuit to be controlled, a knob (9) partially inserted into the case (2), a drive shaft (10) at least partially housed in the case (2) with a first end (11) associated with the knob (9) to be integral in rotation therewith and a second end (12) interacting with the variable resistance to vary the instantaneous value thereof upon the rotation of the shaft (10). The electric adjustment device (5) comprises a box-like housing (14) coupled to the electrical connection means (8) and housing the variable resistance and having a longitudinal passing-through hole (15) suitable for snugly fit the second end (12) of the shaft (10).

11 Claims, 3 Drawing Sheets

(56) References Cited

U.S. PATENT DOCUMENTS

| | | | | | |
|---|---|---|---|---|---|
| 3,970,986 | A | * | 7/1976 | Seyler | H01C 10/36<br>338/171 |
| 4,400,686 | A | * | 8/1983 | Pitcher | H01C 10/32<br>338/184 |
| 4,453,152 | A | * | 6/1984 | Dob | D05B 19/006<br>338/134 |

* cited by examiner

POTENTIOMETER FOR CONTROLLING ELECTRICAL CIRCUITS

TECHNICAL FIELD

The present invention finds application in the field of electrical devices for industrial use and particularly relates to a potentiometer adapted for being connected to an electrical circuit to vary or control the electrical parameters thereof.

STATE OF THE ART

As known, potentiometers are electrical devices with variable resistance designed to be connected to an electrical circuit to control the electrical parameters thereof by varying a resistance.

The potentiometers are mainly used as a voltage divider or for the regulation of the electric current circulating in a circuit.

Typically, they are formed by an electric regulator or trimmer of a rotary type, comprising a shaft which, through rotation around its own axis, interacts with a variable resistance.

The electric regulator device is in turn contained within a tubular housing, while the shaft is connected to a knob designed to be manually rotated by the user.

The typically required features for potentiometers are sufficient resistance to impacts and vibrations, in order to avoid unnecessary movements and consequent variations in resistance, and a degree of protection against the entry of dirt or liquids, based on the intended use of the device.

Typical examples of rotary potentiometers are disclosed in DE102008048470 and in CN104328608, wherein a potentiometer comprises a housing for receiving the resistor and a knob that engages the portion of the shaft, which on one side is in contact with the resistor and on the other projects outward from the housing to allow the user to rotate it.

The knob can also be provided with rotation-limiting means which limit its angular rotation to avoid the movable components of the resistance from hardly striking the abutment surfaces of the same knob, causing possible damage or failure of the movable components themselves.

Since these devices are often designed to be installed in particularly difficult environments, such as machine rooms or outdoors, they must be protected against the infiltration of dirt particles, liquids and possibly oxidizing or corrosive substances that could affect their efficiency.

For these reasons it is necessary to provide suitable sealing means such as sealing rings or similar means.

However, the common solutions of the prior art are limited by the fact that usually a non-negligible portion of the shaft is placed externally to the sealing elements and is therefore not adequately protected against the penetration of dirt particles or the infiltration of liquids, limiting only partially infiltration of dust or impurities outside the electric potentiometer.

GB2061625 discloses a potentiometer inserted inside a control unit that also houses an electronic PCB cardboard.

However, this potentiometer is not designed as a self-standing element for panel-type applications, so requiring specific and complex operations to its connection to the PCB and to the electrical wiring terminals, in such a manner that the potentiometer cannot be directly wired to the device to be controlled.

Last but not least, the knob is not directly accessible from the outside but only through a tool, for example the tip of a screwdriver.

EP2815409, in the name of the same Applicant, discloses a rotary potentiometer wherein the shaft is instead adequately protected by means of an annular gasket adapted to be clamped between two opposed cylindrical surfaces belonging to the knob and to a clamping ring adapted to be removably applicable to the knob.

This potentiometer, although particularly effective in solving the above drawbacks linked to the possible entry of dirty or liquids, may however be limited in some applications by having the component which integrates both the shaft and the variable resistance that is particularly robust and specially designed, and therefore relatively expensive, often being oversized and economically not convenient for applications wherein the potentiometer is not normally subjected to particularly severe conditions.

SCOPE OF THE INVENTION

The object of the present invention is to overcome the above drawbacks by providing a potentiometer for the control of electrical circuits which is characterized by high efficiency and relative cheapness.

A particular object is to provide a potentiometer for controlling electrical circuits which is provided with a particularly simple structure but which at the same time has adequate resistance features.

Still another object is to provide a potentiometer for controlling electrical circuits which ensures adequate protection against the entry of impurities and liquids.

These objects, as well as others which will become more apparent hereinafter, are achieved by a potentiometer for controlling electrical circuits which, according to claim 1, comprises a cylindrical case having an enlarged and open upper edge portion adapted to be inserted inside a hole present in a control panel or distribution board of an electric or electronic device to be controlled, means for the removable anchoring of said cylindrical case to the control panel or distribution board, an electric adjustment device housed in said case and which encloses a variable resistor, means for the electrical connection of said electric adjustment device to the circuit to be controlled, a knob partially inserted in said case to be accessible from the outside, a drive shaft having a longitudinal rotation axis with a first end associated to said knob to be integral in rotation therewith and a second end adapted to interact with said variable resistance to vary its instantaneous value upon the rotation of said shaft, wherein said electric adjustment device comprises a box-shaped housing adapted to be coupled to said electrical connection means and housing said variable resistance, said housing having a longitudinal through hole adapted to snugly fit measure said second end of said shaft to bring it into contact with said variable resistance.

Thanks to this combination of features it will be possible to realize the potentiometer using standard type components available on the market, to simplify the construction thereof and reduce the cost, but without any prejudice to the overall resistance and protection features of the potentiometer.

Advantageously, the electric adjustment device will comprise output terminals in electrical connection with input terminals of the electrical connection means through a conductive plate arranged longitudinally in said case.

The potentiometer may be electrically connected to the electrical or electronic device to be controlled, such as a machine or industrial plant or a device for domestic use, in an immediate manner since it will be necessary to only carry out the wiring of the output terminals of the electrical circuit with the electric connection means, for example a terminal board or a plurality of wiring terminals.

Preferably, the knob will comprise an annular element adapted to be inserted in said open edge of said case and a longitudinally elongated gripping element which extends from said annular element towards the outside of said case and which houses said shaft at its inside.

In turn, the first end of said shaft may be removably arranged in said hollow gripping element.

In this way the assembly of the knob will be particularly simplified and may be obtained starting from standard pieces, further reducing costs.

Advantageous embodiments of the invention are obtained according to the dependent claims.

BRIEF DISCLOSURE OF THE DRAWINGS

Further features and advantages of the invention will become more apparent in the light of the detailed description of a preferred but not exclusive embodiment of a potentiometer for controlling electrical circuits according to the invention, illustrated by way of non-limiting example with the aid of the attached drawing tables wherein.

BEST MODE OF CARRYING OUT THE INVENTION

With reference to the attached figures, a preferred but not exclusive embodiment of a potentiometer is shown, adapted for controlling electrical parameters of any external electrical circuit through the variation of an electrical resistance.

The potentiometer may be used both inside electrical systems or electrical or electronic devices for civil use as well as in machines or industrial plants.

Its function may be that of a voltage divider and/or of controlling the current supplied to a load, or, again, to generate variable signals for the control of industrial equipment.

For example, the potentiometer may be used to selectively vary the voltage in the circuit and consequently modify the value of the electric current therein, or it may be installed in small electronic devices which require the adjustment of one or more control signals.

In general, the potentiometer will be designed to be anchored, preferably in a removable manner, to a panel or distribution board of the electric or electronic device to be controlled, through its insertion in a suitable hole provided in the panel or board.

Figure 1:
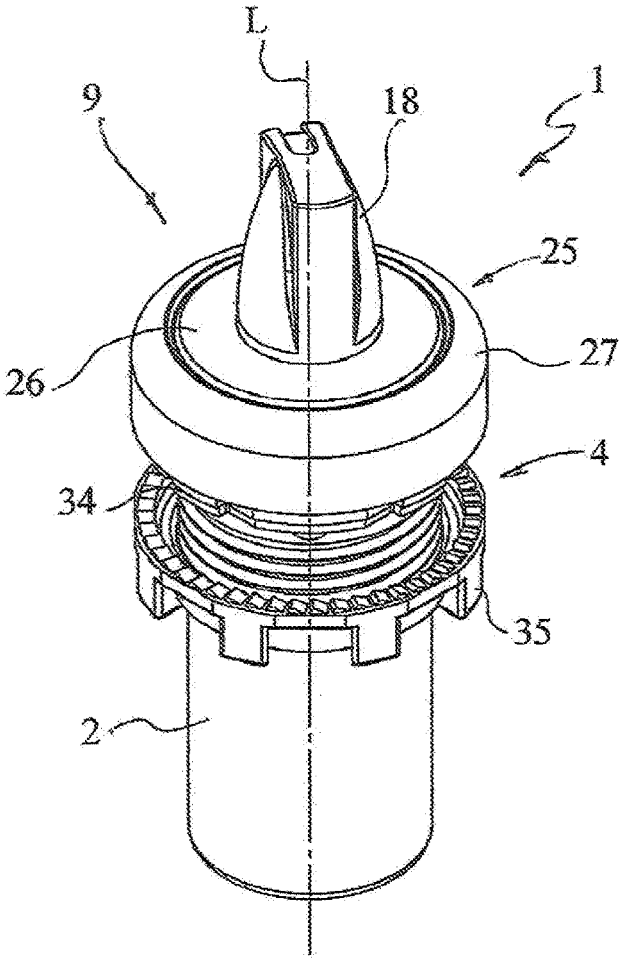
FIG. 1 is a perspective top view of the potentiometer.

As shown in FIG. 1, in its most general embodiment the potentiometer, generally shown with 1, comprises a cylindrical case 2 having an upper open edge portion 3 adapted to be inserted inside the hole present in the panel or board of the device to be controlled, not shown.

In particular, the upper portion 3 of the housing 2 will be enlarged to be brought into abutment on the control panel or distribution board and be locked therewith by means of suitable removable anchoring means 4, described in greater detail hereinafter.

Figure 2:
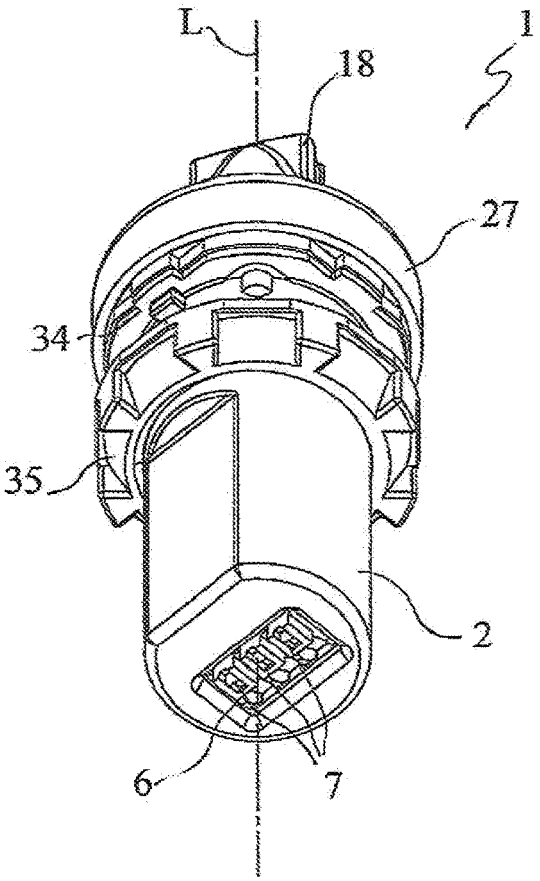
FIG. 2 is a perspective bottom view of the potentiometer.

The case 2 houses an electric adjustment device 5, for example a trimmer, which in turn encloses a variable resistance, and a terminal board 6, more clearly visible in FIG. 2, provided with output terminals 7 adapted to be connected to the electric circuit to be controlled, according to known methods, for example by tightening or welding the cables to the same electrical contacts of the output terminals 7.

The terminal block 6 is also placed in electrical continuity with the electrical adjustment device 5 through suitable electrical connection means 8 so as to bring the device 5 into electrical connection with the external circuit and allow it to control the electrical parameters.

In general, the terminal block 6 will be a component provided with electrical connection terminals, for example of screw-type, spring-type or in any case selected among the terminals of the known type, and it will not necessarily be a unitary element provided with several terminals as it will also be possible provide one or more single terminals.

The control of the adjustment device 5 and the variation of the resistance is carried out by means of a knob 9 partially inserted inside the case 2 to be accessible from the outside by a user's hand.

The knob 9 is made integral in rotation with a drive shaft 10 having a longitudinal rotation axis L.

In the shown embodiment, the drive shaft 10 is partially housed inside the case 2, with its first upper end 11 projecting outside thereof to fit into the knob 9.

However, according to not shown alternative variants, the shaft 10 may also be completely external to the case 2.

The shaft 10 has a first end 11 firmly associated with the knob 9 to be dragged into rotation by the same upon the action exerted by the user.

A second end 12 of the shaft 10 instead engages the variable resistance, which may generally comprise a sliding contact, not visible from the figures, interacting with a conductive winding, which is also not visible, and connected to output terminals 13 so that the position of the contact with respect to the winding, controlled by the rotation of the shaft 10, determines the instantaneous value of the resistance of the circuit.

The variable resistance circuit is housed inside a box-shaped housing 14 and is coupled to the electrical connection means 8.

Figure 3:
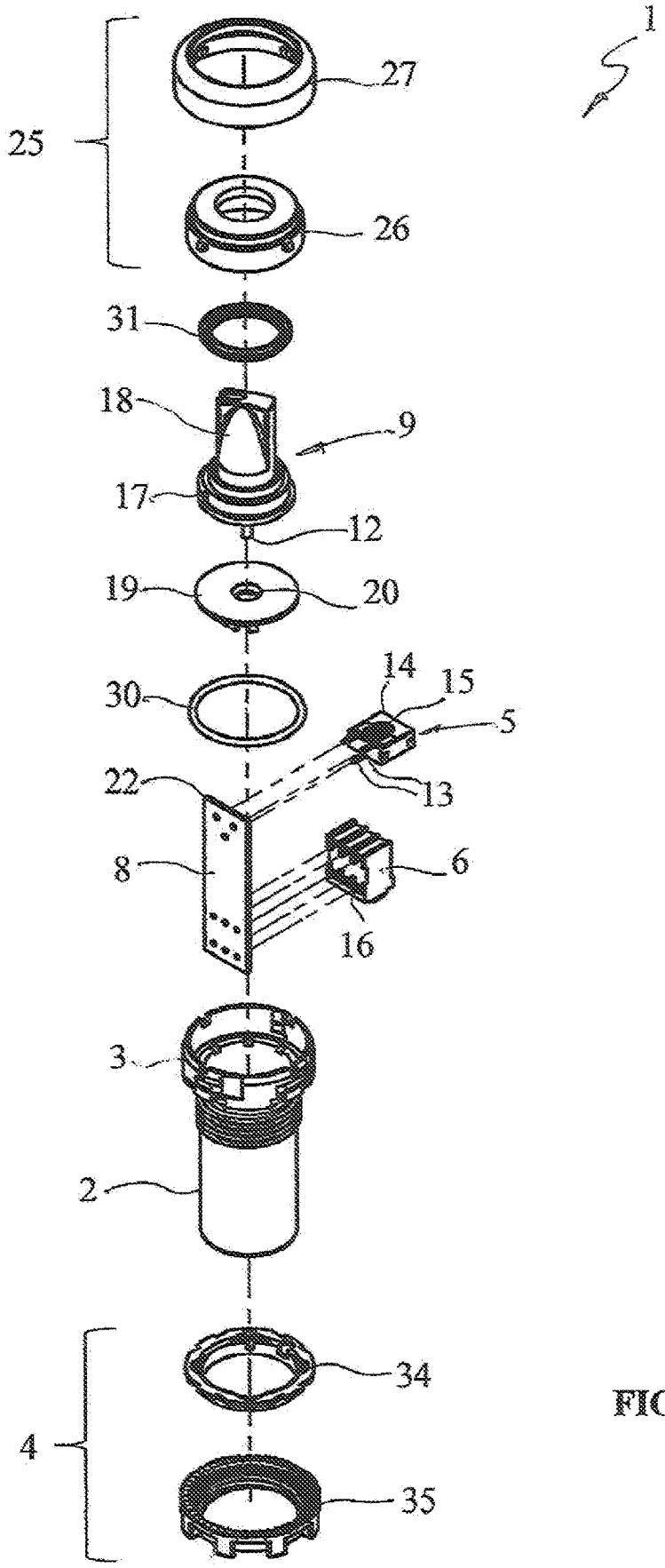
FIG. 3 is an exploded perspective view of the potentiometer.

FIG. 3 shows an exploded view of the potentiometer 1, from which it is possible to observe the various components.

Figure 4:
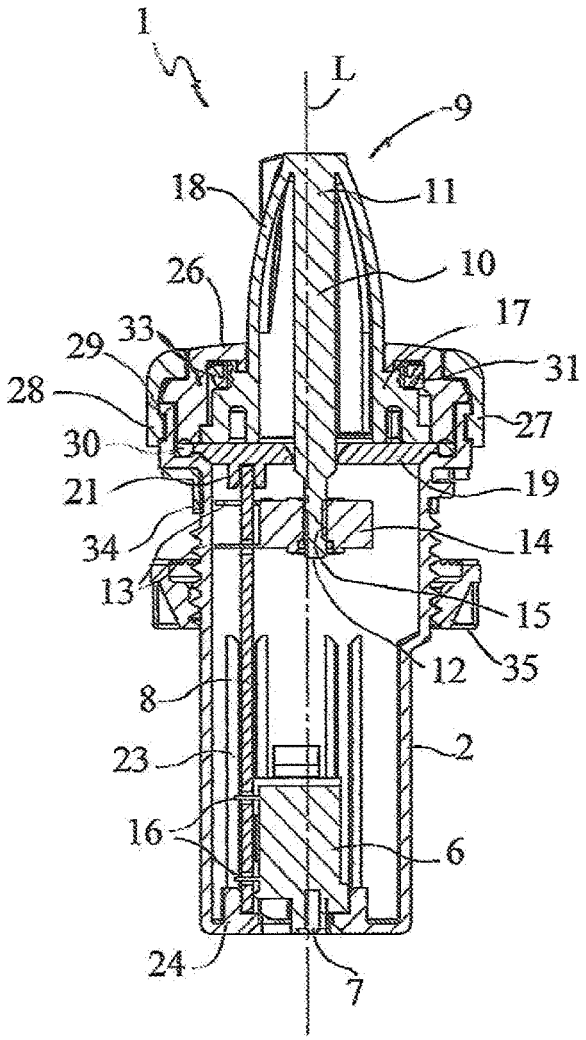
FIG. 4 is a first cross-sectional view of the potentiometer.

As can be seen more clearly from FIG. 4, the housing 14 has a central longitudinal hole 15 able to snugly fit the second end 12 of the shaft 10 so that it fits into the hole 15 and interacts with the sliding contact of the variable resistance circuit.

In a preferred but not exclusive manner, the electrical connection means 8 comprise or consist of a conductive plate arranged longitudinally inside the case 2 and adapted to put in electrical continuity the output terminals 13 of the regulation device 5 with the input terminals 16 of the terminal block 6.

The knob 9 comprises an annular peripheral portion 17 adapted to be inserted inside the enlarged and open edge portion 3 of the case 2 and a longitudinally elongated gripping element 18 which extends from the annular peripheral portion 17, integral therewith, towards the outside of the case 2.

The gripping element 18 is internally hollow to house inside it a part of the drive shaft 10, which will have its first end 11 made integral in rotation, in a fixed or removable manner, to the knob 9.

The first end 11 of the shaft 10 may be integral with the gripping element 18, for example making them as one piece or with a single mold or by welding, or it may be removably coupled and locked by interlocking.

The knob 9 also comprises a centering disk 19 adapted to occlude the open end edge 3 of the case 2 and having a central passage 20 for the second end 12 of the shaft 10.

The centering disk 19 also has an appendix 21 projecting longitudinally towards the inside of the case 2 and adapted to engage the upper edge 22 of the conductive plate 8 so as to keep it in a longitudinal position and avoid bending thereof during use and rotation of the shaft 10.

Figure 5:
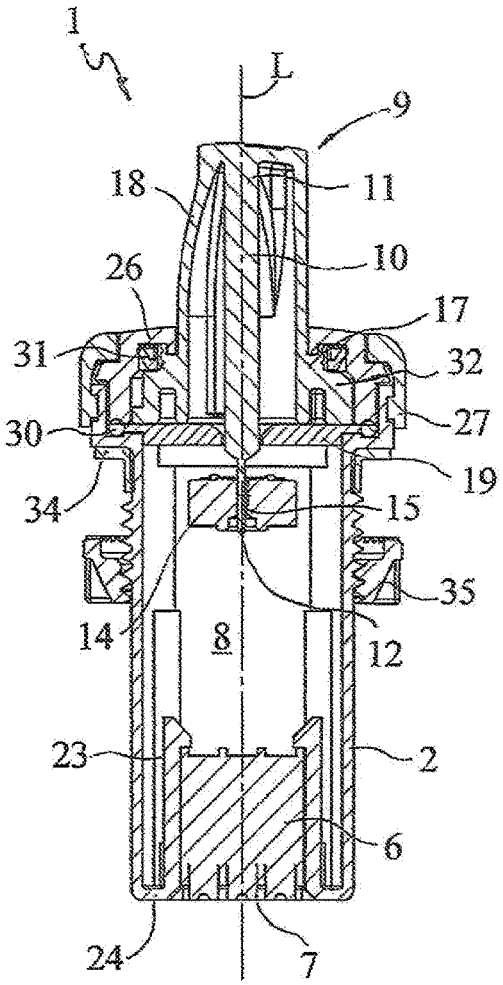
FIG. 5 is a second cross-sectional view of the potentiometer.

To this end, the case 2 will be provided with longitudinal guides 23, more clearly visible in FIG. 5, projecting from its bottom wall 24 and which will guide the insertion of the conductive plate 8, keeping it in a longitudinal position.

The fixing of the knob 9 to the case 2 will be obtained by means of a fixing ring 25 which will cover its peripheral annular portion 17.

In particular, the fixing ring 25 comprises an inner annular element 26 which is positioned on the peripheral annular portion 17 and an annular covering element 27 which is positioned on the inner annular element 26 to snap-fit with the upper open edge 3 of the case 2, so as to axially lock the knob 9 with respect to the case 2, in any case allowing its rotation around the longitudinal axis L.

The snap coupling of the annular covering element 27 may be obtained by inserting one or more teeth or an annular peripheral projection 28 inside a peripheral groove 29 provided in the enlarged edge portion 3 of the case 2.

A first tightening seal 30, for example an O-ring or the like, will also be interposed between the fixing ring 25 and the open edge 3 of the case 2.

A second tightening seal 31, for example a lip seal, is interposed between the annular peripheral portion 17 of the knob 9 and the fixing ring 25.

The sealing means as a whole will guarantee the necessary protection against the entry of impurities and/or liquids.

The knob 9 will also be suitably provided with rotation limitation means which will prevent its rotation in both directions beyond a predetermined angle of rotation, which will preferably be equal to the moving angle of the movable contact of the variable resistance circuit of the adjustment device 5.

By way of example, the knob 9 comprises an abutment tooth 32 integral with its peripheral annular portion 17 and adapted to interact with an abutment surface 33 of the fixing ring 25 upon the rotation with maximum angle around the longitudinal axis L.

The means for limiting the rotation will have the purpose of preventing the transmission of excessive stresses to the adjustment device 5, and in particular to its internal resistance, through the knob 9.

The locking of the case 2 to the panel or distribution board will be achieved by the interaction between a stop ring 34 placed immediately under the enlarged edge portion 3 and a locking ring nut 35 suitable to be screwed externally to the case 2 so that the panel or distribution board of the electric or electronic device is tightened between the ring nut 35 and the stop ring 34, stably locking the potentiometer.

The potentiometer according to the invention is susceptible of numerous modifications and variations, all of which are within the scope of the inventive concept expressed in the appended claims. All the details may be replaced by other technically equivalent elements, and the materials may be different according to requirements, without departing from the scope of protection of the present invention.

Even if the potentiometer has been disclosed with particular reference to the attached figures, the reference numbers used in the description and in the claims are used to improve the intelligence of the invention and do not constitute any limitation to the claimed scope of protection.

The invention claimed is:

1. A potentiometer for controlling an electrical circuit, wherein the electric circuit belongs to an electrical device provided with a control panel or distribution board, comprising:

a cylindrical case (2) having an enlarged and open upper edge portion (3);

means (4) for removably anchoring said cylindrical case (2) to the panel or board;

an electric adjustment device (5) housed in said case (2) and enclosing a variable resistance;

means (8) for the electrical connection of said electrical adjustment device (5) to the circuit to be controlled and having a terminal board (6) provided with output terminals (7) and with input terminals (16);

a knob (9) partially inserted into said case (2) to be handled from the outside;

a drive shaft (10) having a longitudinal rotation axis (L) with a first end (11) associated with said knob (9) to be integral in rotation therewith and a second end (12) which engages said variable resistance to vary the instantaneous value thereof upon the rotation of said shaft (10);

wherein said electric connection means (8) consist of an electrically conductive plate arranged longitudinally in said case (2) to place said output terminals (13) of said adjustment device (5) in electrical continuity with said input terminals (16);

characterized in that said electric adjustment device (5) comprises a box-like housing (14) coupled to said electrical connection means (8) and housing said variable resistance, said housing (14) having a longitudinal passing-through hole (15) suitable for snugly fit said second end (12) of said shaft (10) to bring it into contact with said variable resistance.

2. Potentiometer as claimed in claim 1, characterized in that said electric adjustment device (5) comprises output terminals (13) in electrical connection with input terminals (16) of said electrical connection means (8).

3. Potentiometer as claimed in claim 2, characterized in that said knob (9) comprises an annular peripheral portion (17) inserted in said open edge portion (3) of said case (2) and a longitudinally elongated gripping element (18) which extends from said annular peripheral portion (17) towards the outside of said case (2) and which partially houses said shaft (10) thereinside.

4. Potentiometer as claimed in claim 3, characterized in that said first end (11) of said shaft (10) is integral with said gripping element (18).

5. Potentiometer as claimed in claim 4, characterized in that said gripping element (18) is hollow, said first end (11) of said shaft (10) being removably arranged in said hollow gripping element (18).

6. Potentiometer as claimed in claim 5, characterized in that said knob (9) comprises a centering disk (19) adapted to occlude said open end edge portion (3) of said case (2) and having a central passage (20) for said second end (12) of said shaft (10).

7. Potentiometer as claimed in claim 6, characterized in that said centering disk (19) comprises an appendix (21)

longitudinally projecting towards the inside of said case (2) and adapted to engage the upper edge (22) of said conductive plate (8).

8. Potentiometer as claimed in claim 7, characterized in that said knob (9) comprises a fixing ring (25) adapted to cover said annular peripheral portion (17) and for snap coupling with the open upper edge portion (3) of said case (2) for the axial locking of said knob (9) with respect to said case (2).

9. Potentiometer as claimed in claim 8, characterized by comprising sealing means (30, 31) interposed between said fixing ring (25) and said open edge portion (3) of said case (2).

10. Potentiometer as claimed in claim 1, characterized in that said case (2) comprises one or more longitudinal guides (23) projecting from its bottom wall (24) for guided insertion of said conductive plate (8) and for keeping it in a longitudinal position.

11. Potentiometer as claimed in claim 1, characterized by comprising means (32, 33) for limiting the rotation of said knob (9) adapted to limit the maximum rotation thereof about said longitudinal axis (L) to a predetermined value.

* * * * *